US009334734B2

(12) United States Patent
Hong et al.

(10) Patent No.: US 9,334,734 B2
(45) Date of Patent: May 10, 2016

(54) ROBOT FOR MINING MANGANESE NODULES ON DEEP SEAFLOOR

(71) Applicant: KOREA INSTITUTE OF OCEAN SCIENCE & TECHNOLOGY, Ansan-si, Gyeonggi-do (KR)

(72) Inventors: Sup Hong, Daejeon (KR); Hyung-Woo Kim, Daejeon (KR); Jong-Su Choi, Daejeon (KR); Tae-Kyeong Yeu, Daejeon (KR)

(73) Assignee: Korea Institute of Ocean Science & Technology, Ansan-si (KR)

( * ) Notice: Subject to any disclaimer, the term of this patent is extended or adjusted under 35 U.S.C. 154(b) by 45 days.

(21) Appl. No.: 14/387,200

(22) PCT Filed: Oct. 12, 2012

(86) PCT No.: PCT/KR2012/008296
§ 371 (c)(1),
(2) Date: Sep. 22, 2014

(87) PCT Pub. No.: WO2013/147379
PCT Pub. Date: Oct. 3, 2013

(65) Prior Publication Data

US 2015/0047233 A1 Feb. 19, 2015

(30) Foreign Application Priority Data

Mar. 28, 2012 (KR) ..... 10-2012-0031912

(51) Int. Cl.
*E21C 50/00* (2006.01)
*E02F 3/88* (2006.01)
(Continued)

(52) U.S. Cl.
CPC ..... *E21C 50/00* (2013.01); *E02F 3/8866* (2013.01); *E02F 3/907* (2013.01); *E02F 3/9206* (2013.01); *E02F 7/023* (2013.01); *E02F 7/065* (2013.01)

(58) Field of Classification Search
CPC ..... E02F 3/8866; E02F 3/8858; E02F 3/907; E02F 3/90; E02F 3/92; E02F 3/94; E02F 3/9206; E02F 7/065; E02F 7/023; E21C 50/00; F04D 15/0083; F04D 15/0066; B62D 55/00; B62D 55/08; B62D 55/065
USPC ..... 37/308, 309, 310, 312, 314, 317, 320; 299/8; 417/54, 108
See application file for complete search history.

(56) References Cited

U.S. PATENT DOCUMENTS 3,971,593 A * 7/1976 Porte ..... E21C 50/00 299/8
4,232,903 A * 11/1980 Welling ..... E02F 3/8858 241/1

(Continued)

FOREIGN PATENT DOCUMENTS

JP 55-98594 7/1980
JP 57-54696 4/1982

(Continued)

OTHER PUBLICATIONS

Japanese Office Action dated Jul. 23, 2015 of the corresponding Japanese Patent Application No. 2014-158525, noting listed references in this IDS.

(Continued)

*Primary Examiner* — Robert Pezzuto
(74) *Attorney, Agent, or Firm* — Lewis Roca Rothgerber Christie LLP

(57) ABSTRACT

A robot for mining a manganese nodule on a deep sea floor. The apparatus includes a plurality of moving apparatuses detachably disposed in parallel with each other; a mining apparatus installed to a front end of the moving apparatuses to mine a manganese nodule; a transferring apparatus installed to an upper portion of the moving apparatuses to crush the manganese nodule in a constant size or less such that the manganese nodule is transferred to an external; a power control measuring unit installed to an upper portion of the moving apparatuses for providing power to the moving apparatuses and controlling operations of the mining apparatus and the transferring apparatus; a structure frame for connecting the moving apparatuses to each other and for supporting the mining apparatus, the transferring apparatus and the power control measuring unit; and a buoyancy unit installed to a top end of the structure frame.

8 Claims, 7 Drawing Sheets

(51) Int. Cl.

| | |
|---|---|
| ***E02F 3/90*** | (2006.01) |
| ***E02F 3/92*** | (2006.01) |
| ***E02F 7/02*** | (2006.01) |
| ***E02F 7/06*** | (2006.01) |

(56) References Cited

U.S. PATENT DOCUMENTS

| | | | | |
|---|---|---|---|---|
| 4,334,370 | A * | 6/1982 | Holzenberger | F04D 15/0083 37/195 |
| 4,391,468 | A * | 7/1983 | Funk | E02F 3/90 299/8 |
| 8,165,722 | B2 * | 4/2012 | Yoon | G05D 7/06 299/8 |

FOREIGN PATENT DOCUMENTS

| | | | |
|---|---|---|---|
| JP | 58-76696 | | 5/1983 |
| JP | 2-164997 | | 6/1990 |
| JP | 11-117658 | | 4/1999 |
| JP | 2008-272684 | | 11/2008 |
| KR | 10-0795667 | | 1/2008 |
| KR | 10-2011-0045135 | | 5/2011 |
| KR | 10-1363248 | B1 | 2/2014 |
| KR | 10-1391634 | B1 | 5/2014 |
| WO | WO 2012/023676 | A1 | 2/2012 |
| WO | WO 2013/147379 | A1 | 10/2013 |

OTHER PUBLICATIONS

European Search Report for Application No. 14180037.5, dated Feb. 3, 2015, 6 pages.

International Search Report, corresponding to PCT/KR2012/008296, dated Mar. 25, 2013, 6 pages.

Choi, et al., "Application Study on FMEA(Failure Mode and Effect Analysis) for Waterjet-lifter of Deep-Sea Manganese Nodule Miner," Journal of Ocean Engineering and Technology, Dec. 2009, vol. 23, No. 6, pp. 32-38, ISSN 1225-0767.

Hong, et al., "Design of a Pilot Mining Robot for Deep-seabed Manganese Nodule," Maritime and Ocean Engineering Research Institute, KORDI, Daejeon, Korea, 2011, pp. 22-25, ISSN 2092-7797.

* cited by examiner

ROBOT FOR MINING MANGANESE NODULES ON DEEP SEAFLOOR

CROSS-REFERENCE TO RELATED APPLICATION(S)

This application is a National Phase Patent Application and claims priority to and benefit of International Application Number PCT/KR2012/008296, filed on Oct. 12, 2012, which claims priority to and benefit of Korean Patent Application Number 10-2012-0031912, filed on Mar. 28, 2012, the entire disclosures of which are incorporated herein by reference.

TECHNICAL FIELD

The present invention relates to a robot for mining a manganese nodule on a deep sea floor, and more particularly, to an apparatus for mining a manganese nodule on a deep sea floor which may be connected in parallel to another apparatus and has a robot function of additional extension according to an amount of mined manganese nodules.

BACKGROUND ART

In general, since an endless track vehicle, which is used in civil engineering, construction and agriculture fields, is driven on the hard ground surface, particularly low ground contact pressure is not required, so that a width of an endless track is relatively narrowed.

However, a low ground contact pressure is required to an endless track vehicle driven on a weak sticky ground such as a weak ground of a deep sea floor or tidal mudflat such that the endless track vehicle is prevented from being buried under the ground surface.

To solve the problems, one example of the related art is disclosed in Korea Patent No. 10-0795667.

According to an endless track vehicle having endless tracks divided into two rows disclosed in the related art, the endless tracks are divided into two rows and a support frame for supporting a weight of mounted equipment is reinforced through a space between the divided endless tracks, so that the mounted equipment may be stably supported while the ground contact pressure of the endless track vehicle is reduced.

When manganese nodules distributed on seabed are mined by using the endless track vehicle having endless tracks divided into two rows disclosed in the related art, it is difficult to increase the ground contact pressure over a level.

In addition, it is difficult to control the endless track vehicles independently of each other and mining works having mutually different mining amounts at mutually different places cannot be performed.

DISCLOSURE

Technical Problem

An object of the present invention is to provide a robot for mining a manganese nodule on a deep sea floor, in which moving apparatuses including a mining apparatus and a transferring apparatus are detachably connected in parallel with each other to adjust a capacity for mining manganese nodules and which is capable of securing a safety in the entire structure and maintaining a suitable ground contact pressure.

Technical Solution

According to the present invention, there is provided a robot for mining a manganese nodule on a deep sea floor. The apparatus includes a plurality of moving apparatuses detachably disposed in parallel with each other; a mining apparatus installed to a front end of the moving apparatuses to mine a manganese nodule; a transferring apparatus installed to an upper portion of the moving apparatuses to crush the manganese nodule in a constant size or less such that the manganese nodule is transferred to an external; a power control measuring unit installed to an upper portion of the moving apparatuses for providing power to the moving apparatuses and controlling operations of the mining apparatus and the transferring apparatus; a structure frame for connecting the moving apparatuses to each other and for supporting the mining apparatus, the transferring apparatus and the power control measuring unit; and a buoyancy unit installed to a top end of the structure frame.

Each of the moving apparatuses includes a plurality of endless tracks disposed in parallel with each other in a transverse direction.

The mining apparatus includes a floating apparatus disposed at a front end of the moving apparatus to inject water jet to seabed such that the manganese nodule placed on the seabed is floated and induced into an inside of the floating apparatus; a carrying apparatus connected to the floating apparatus to receive power from the power control measuring unit such that the floated manganese nodule is transferred to the transferring apparatus; an electronic stability control apparatus for receiving power from the power control measuring unit to elevate the floating apparatus and the carrying apparatus such that a preset height is formed between a bottom end of the floating apparatus and the seabed; a mining apparatus frame for connecting the floating apparatus and the carrying apparatus to each other in a single unit; and a frame to which the electronic stability control apparatus is installed, wherein the frame connects the mining apparatus frame to the structure frame.

A water jet injection nozzle for injecting the water jet and a flowing guide plate are installed in the floating apparatus.

The transferring apparatus includes a crushing apparatus adjacent to the mining apparatus for receiving power from the power control measuring unit to crush the manganese nodule transferred by the carry apparatus at a constant size or less; a transferring pump connected to the crushing apparatus to receive power from the power control measuring unit such that the crushed manganese nodule is transferred; a transferring pipe connected to the transferring pump to form a transferring path through which the manganese nodule is transferred to an outside; and a dump valve installed on the transferring pipe to receive power from the power control measuring unit such that the transferring pipe and the transferring pump are prevented from being clogged while the crushed manganese nodule is transferred.

The structure frame includes a moving apparatus connecting frame for detachably connecting the moving apparatuses to each other; a mining apparatus connecting frame connected to the moving apparatus connecting frame to support the mining apparatus; a transferring apparatus connecting frame for supporting the transferring apparatus; a power control measuring unit connecting frame for supporting the power control measuring unit; and a body frame for connecting the moving apparatus connecting frame, the mining apparatus connecting frame, the transferring apparatus connecting frame and the power control measuring unit connecting frame to each other.

The electronic stability control apparatus receives a value of a distance from a surface of seabed from an interval meter installed to the floating apparatus to control an elevation of the floating apparatus such that the distance value is equal to a preset reference distance value.

Advantageous Effects

According to the present invention, the moving apparatuses including a mining apparatus and a transferring apparatus are detachably connected in parallel with each other, so that the number of moving apparatuses is adjustable according to a capacity for mining manganese nodules.

Further, according to the present invention, at least one of the moving apparatuses is changeable.

According to the present invention, the ground contact area can be increased on a weak sticky ground of a deep sea floor.

According to the present invention, the number of moving apparatuses having endless tracks can be adjusted according to submarine topography of a mining object.

According to the present invention, since the plurality of endless tracks may be individually driven, the endless tracks may be driven at mutually different rotation speeds, respectively, so that the traversability may be greatly improved at an arbitrary position on submarine topography.

In addition, according to the present invention, the plurality of moving apparatuses including a mining apparatus and a transferring apparatus are provided so that the entire mining capacity can be effectively adjusted.

BEST MODE

Mode for Invention

Hereinafter, a robot for mining a manganese nodule on a deep sea floor according to the present invention will be described with reference to accompanying drawings.

Figure 1:
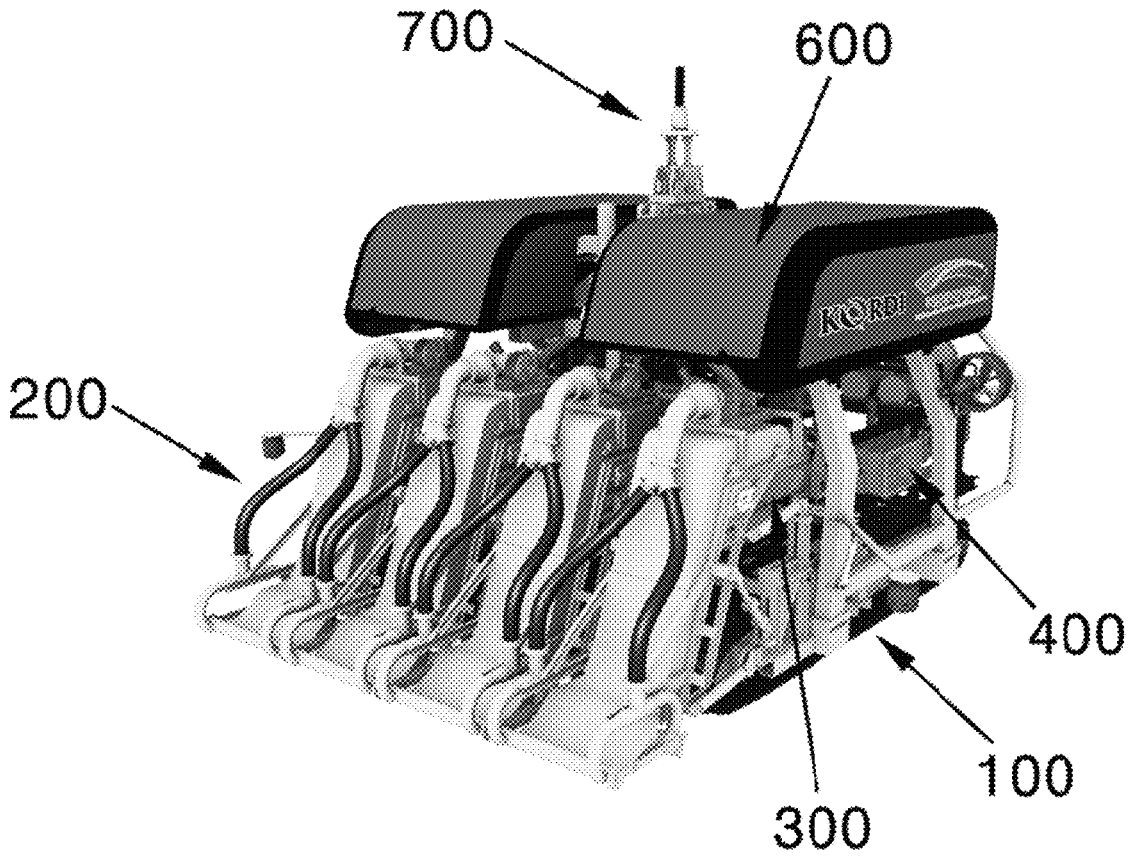
FIG. 1 is a perspective view showing a configuration of a robot for mining a manganese nodule on a deep sea floor according to the present invention.
Figure 2:
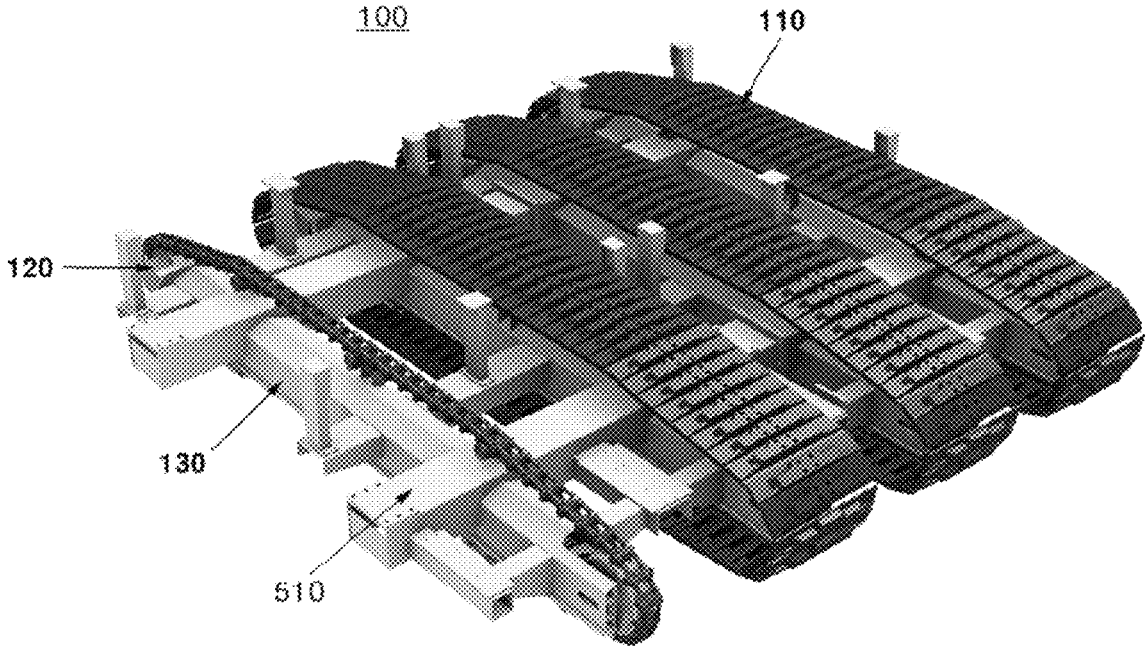
FIG. 2 is a perspective view showing the moving apparatus of FIG. 1.

FIG. 1 is a perspective view showing a configuration of a robot for mining a manganese nodule on a deep sea floor according to the present invention. FIG. 2 is a perspective view showing the moving apparatus of FIG. 1.

Referring to FIG. 1, a robot for mining a manganese nodule on a deep sea floor according to the present invention includes a plurality of moving apparatuses 100, a mining apparatus 200, a transferring apparatus 300, a power control measuring unit 400, a structure frame 500, a buoyancy unit 600 and a launching/retrieving unit 700.

Moving Apparatus 100

Referring to FIGS. 1 and 2, each moving apparatus 100 includes an endless track 110, a driving apparatus 120 and a frame 130.

The frames 130 may be disposed in parallel with each other. The driving apparatus 120 is installed to one end of the frame 130 and an idler 120 is installed to the opposite end of the frame 130.

The driving apparatus 120 receives power from the power control measuring unit 400 such that the driving apparatus 120 is rotated.

The endless track 110 is engaged with the driving apparatus 120 such that the endless track 110 is rotated by the rotation of the driving apparatus 120. Practically, the endless track 110 is rotated for the purpose of moving in state that the endless track 100 is placed on a seabed surface.

The moving apparatuses 100 are disposed in a parallel connecting direction.

A moving apparatus connecting frame 510, which will be described below, is installed to the frames 130 of the moving apparatuses 100 while the connecting frame 510 passes through the frames 130. Thus, the moving apparatuses 100 may be connected in parallel with each other.

According to the present invention, each of the moving apparatuses 100 independently includes the endless track 110. In addition, the moving apparatuses 100 may be connected in parallel with each other to be additionally extendable in parallel. The moving apparatuses 100 receive power from the power control measuring unit 400, respectively, such that the moving apparatuses 100 may be independently driven.

Structure Frame 500

Figure 6:
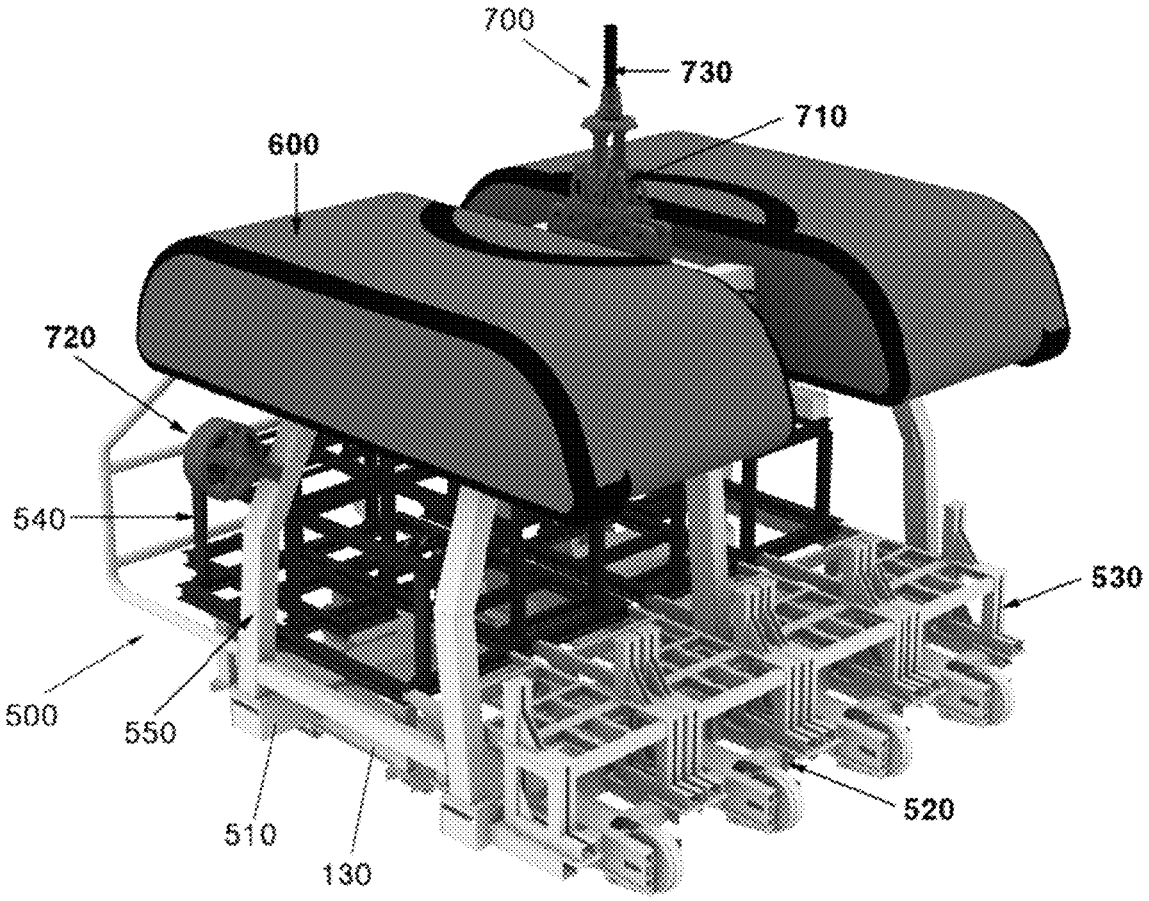
FIG. 6 is a perspective view showing the structure frame, the buoyancy unit and the launching/retrieving unit of FIG. 1

FIG. 6 is a perspective view showing the structure frame of FIG. 1.

The configuration of the structure frame 500 will be described with reference to FIGS. 1 and 6.

The structure frame 500 includes the moving apparatus connecting frame 510, a mining apparatus connecting frame 520, a transferring apparatus connecting frame 530, a power control measuring unit connecting frame 540 and a body frame 550.

The moving apparatus connecting frame 510 is connected the frames 130 of the moving apparatuses 500 while passing through the frames 130 of the moving apparatuses 100 such that the moving apparatuses 100 are connected in parallel with each other.

The perforating direction of the moving apparatus connecting frame 510 may correspond to the parallel connecting direction of the moving apparatuses 100.

Although not shown in the drawings, a bolt coupling scheme or a welding scheme may be applied to the moving apparatus connecting frame 510.

The mining apparatus connecting frame 520 supports the mining apparatus 200. The mining apparatus connecting frame 520 is installed to front ends of the frames 130 provided to each moving apparatus 100.

The transferring apparatus connecting frame 530 is located at a rear end of the mining apparatus connecting frame 520 and is installed to a top end of the moving apparatus connecting frame 510. The transferring apparatus connecting frame 530 supports the transferring apparatus 300.

The power control measuring unit connecting frame 540 is installed on the moving apparatus connecting frame 510 such that the power control measuring unit connecting frame 540 is placed at the rear of the transferring apparatus connecting frame 530. The power control measuring unit connecting frame 540 supports the power control measuring unit 400.

The body frame 550 joins the connecting frames to each other and in addition, includes a plurality of branches such that the body frame 550 surrounds the power control measuring unit connecting frame 540. Both ends of the body frame 550 may be connected to both ends of the moving apparatus connecting frame 510 to be supported.

The buoyancy unit 600 and the launching/retrieving unit 700 may be installed to a top end of the body frame 550.

Mining Apparatus 200

Figure 3:
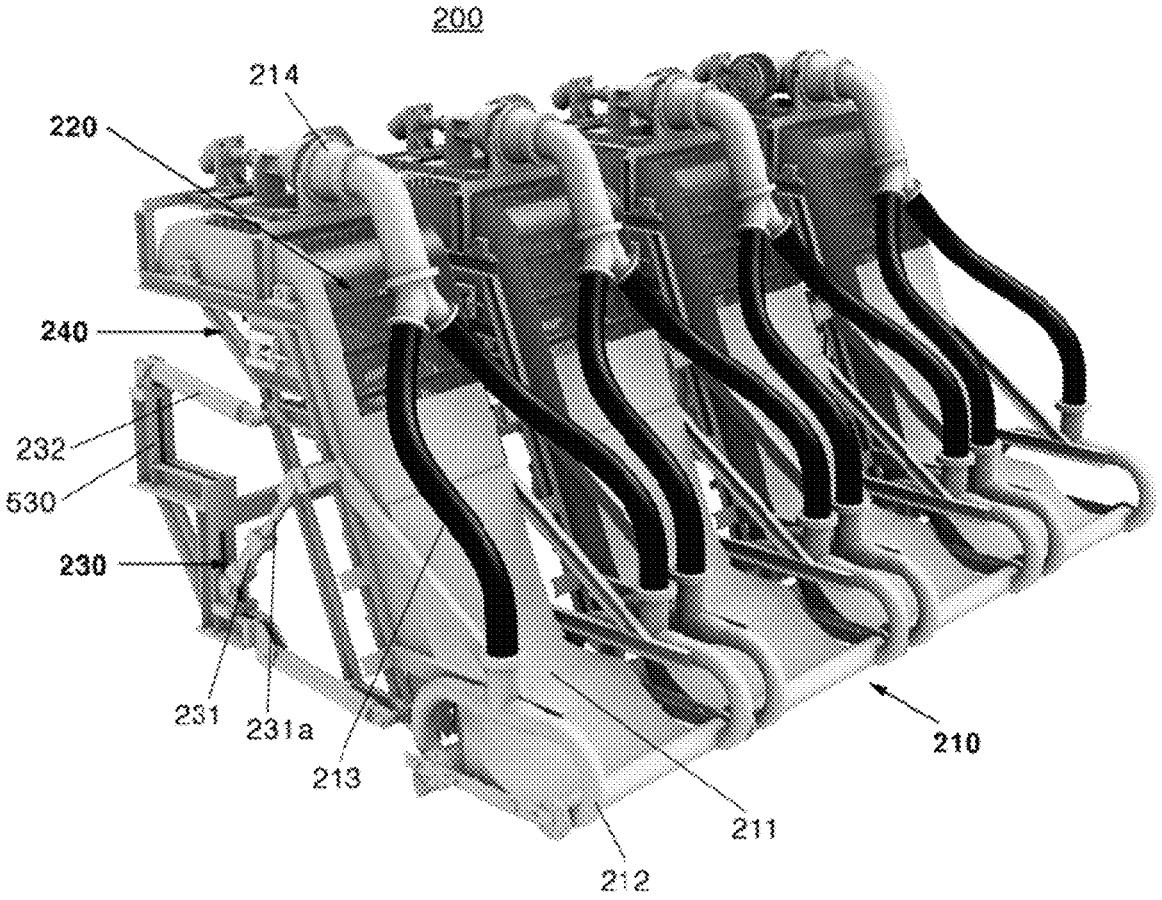
FIG. 3 is a perspective view showing the mining apparatus of FIG. 1.

FIG. 3 shows the mining apparatus.

Referring to FIGS. 1 and 3, at least one mining apparatus 200 may be installed to each moving apparatus 100.

The mining apparatus 200 is supported by the mining apparatus connecting frame 520 installed to the front ends of the frames 130 of each moving apparatus 100.

The mining apparatus 200 includes a floating apparatus 210, a carrying apparatus 220, an electronic stability control apparatus 230, and a frame 240.

The floating apparatus 210 includes an apparatus body 211 having a bottom end which is enabled to be opened, and water jet injection nozzle apparatuses 212 installed at the front/rear portions of both low side ends of the apparatus body 211.

A pump 214 for supplying water jet is installed on a top end of the apparatus body 211. The pump 214 branches out into the water jet injection nozzle apparatuses 212 and pipe lines 213 are provided to transfer a water flow from the pump 214. The pump 214 is driven by the power transferred from the power control measuring unit 400 thereto.

Although not shown in the drawings, the carrying apparatus 220 is installed to an inside of the apparatus body 211 and includes a pair of left and right driving chains connected to a plurality of gears (not shown) to be rotated, a conveyer belt having a plurality of scrapers for connecting the left and right driving chains to each other, a plurality of left and right idlers constituting a shape of the conveyer belt and a pair of left and right sprockets.

The carrying apparatus 220 may receive power from the power control measuring unit 400 and may control the conveyer belt to move at a preset rotation speed.

The electronic stability control apparatus 230 receives power from the power control measuring unit 400 such that the electronic stability control apparatus 230 elevates the floating apparatus 210 to form a preset height between the bottom end of the floating apparatus 210 and the surface of seabed.

The frame 240, on which the electronic stability control apparatus 230 is installed, connects the floating apparatus 210 and the carrying apparatus 220 to each other to constitute one body. The frame 240 is connected to the electronic stability control apparatus 210 and is fixed to the mining apparatus connecting frame 520.

The electronic stability control apparatus 230 includes a pair of left and right parallelogram links 232 and a pair of left and right hydraulic cylinders 231 which receives power from the power control measuring unit 400 to control the movements of the left and right parallelogram links 232.

The electronic stability control apparatus 230 receives a value of a distance from the surface of seabed from an interval meter (not shown) installed to the floating apparatus 210 to control the elevation of the floating apparatus 210 such that the distance value is equal to a reference distance value.

The hydraulic cylinder 231 allows the frame 240 and the apparatus body 211 of the floating apparatus 210 to be hinge-coupled to each other. The hydraulic cylinder 231 has a flexible shaft 231*a*.

Thus, the floating apparatus 210 may be elevated according to whether the shaft 231*a* is lengthened or shortened.

Figure 4:
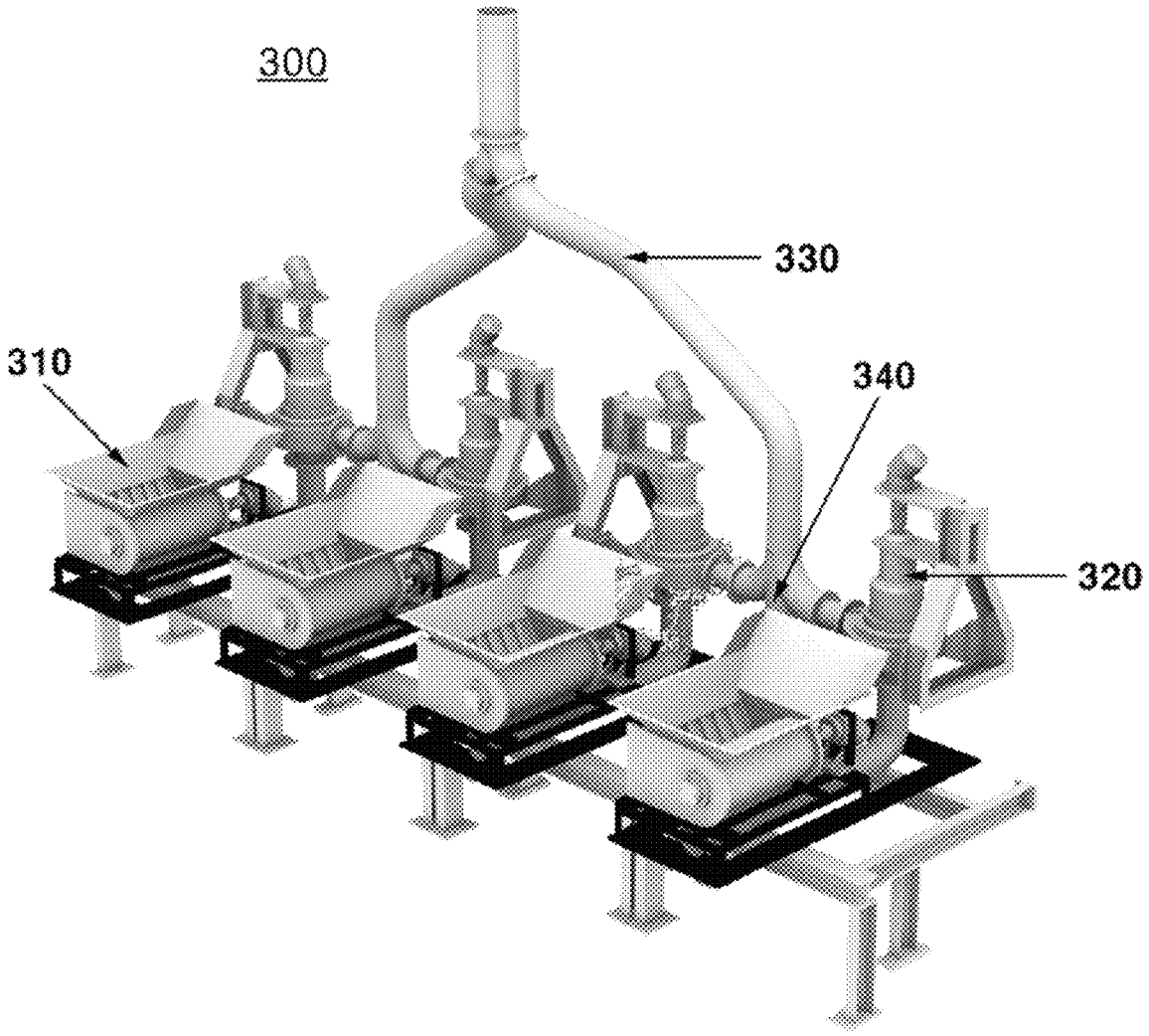
FIG. 4 is a perspective view showing the transferring apparatus of FIG. 1.

In addition, the apparatus body 211 and the frame 240 are connected through the link 232 which stably guides the apparatus body 211 and the frame 240 when the apparatus body 211 and the frame 240 move up and down. FIG. 4 is a perspective view showing the mining apparatus of FIG. 1.

Figure 7:
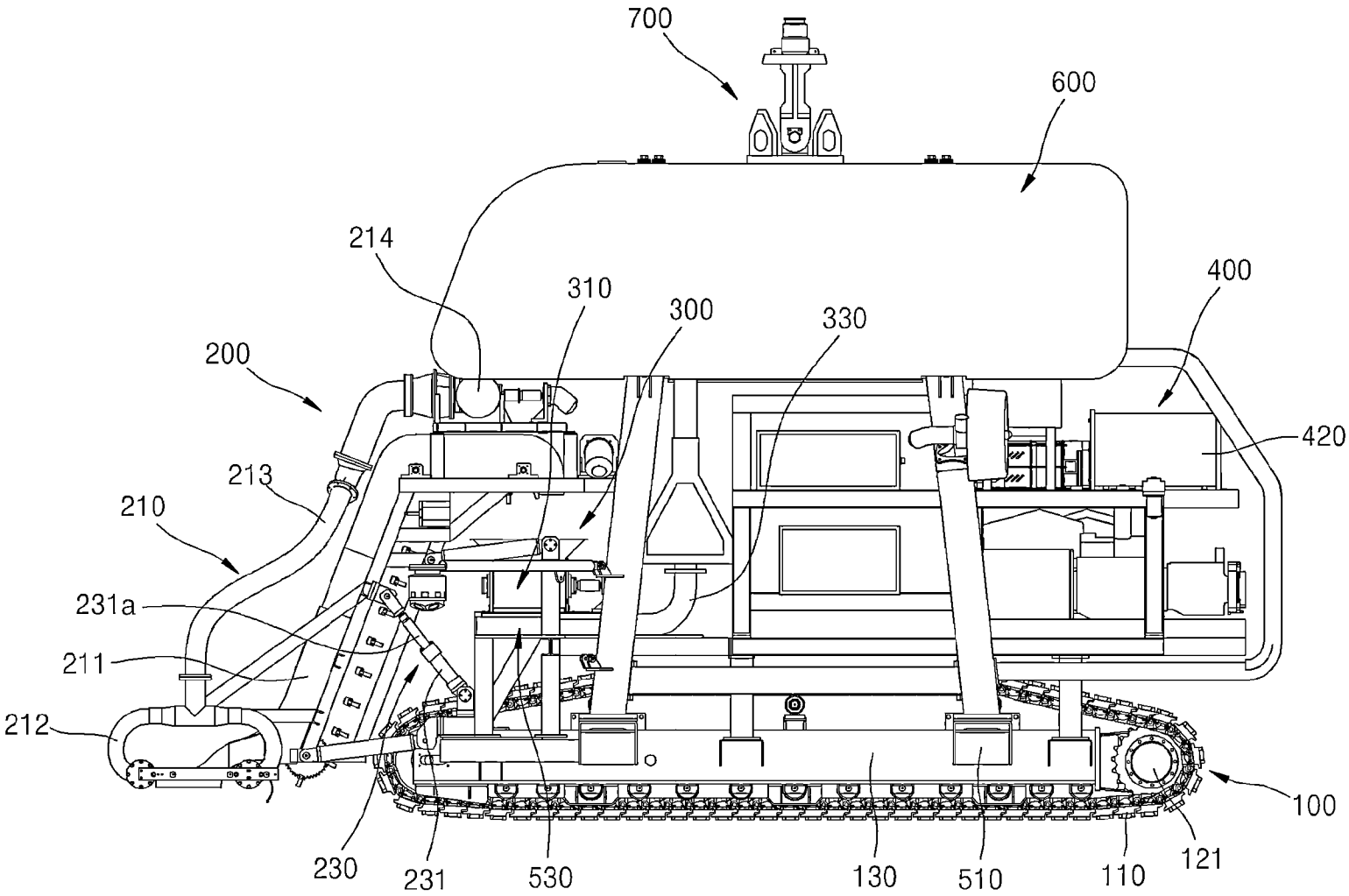
FIG. 7 is a side view showing a robot for mining a manganese nodule on a deep sea floor according to the present invention.

Referring to FIG. 7, in the mining apparatus 200 according to the present invention, the bottom end of the apparatus body 211 of the floating apparatus 210 is spaced apart from the surface of seabed at a predetermined height by a driving of the electronic stability control apparatus 230.

In addition, the floating apparatus 210 forms a water jet injection on a surface of seabed to allow manganese nodules on the surface of seabed to float and flow into the inside of the apparatus body 211.

In this case, the carrying apparatus 220 can carry the manganese nodules introduced therein to the transferring apparatus 300.

Transferring Apparatus 300

FIG. 4 is a perspective view showing the transferring apparatus of FIG. 1

Referring to FIGS. 1 and 4, the transferring apparatus 300 is installed to a rear end of the mining apparatus 200. The transferring apparatus connecting frame 530 is installed to the transferring apparatus 300.

The transferring apparatus includes a crushing apparatus, a transferring pump 320, a transferring pipe 330 and a dump valve 340.

The crushing apparatus 310 includes a receiving part for temporarily receiving the manganese nodules transferred by the carrying apparatus 220. Although not shown in the drawings, crushing gears engaged with each other to be rotated are installed in the receiving part.

Thus, the manganese nodules received in the receiving part are crushed at a constant size or less by the crushing gears rotated by the power transferred from the power control measuring unit 400. In addition to the above, various schemes of crushing manganese nodules may be applicable if it is possible to crush manganese nodules in a predetermined size.

The transferring pipe 330, which is a pipe connected to a riser connected to an external mother ship, forms a transferring path through which the crushed manganese nodules are carried.

The transferring pump 320 is installed on the transferring pipe 330 and receive power from the power control measuring unit 400 to provide a transferring power such that the crushed manganese nodules is carried through the transferring pipe 330.

The dump valve 340 is additionally installed on the transferring pipe 330.

Referring to FIG. 7, the transferring apparatus 300 according to the present invention may crush the manganese nodules carried from the mining apparatus 200 at a constant size or less and then, may discharge the crushed manganese nodules into the transferring pipe 330.

Thus, the manganese nodules discharged from the transferring pipe 330 may be transferred to a mother ship.

Buoyancy Unit 600 and Launching/Retrieving Unit 700

FIG. 6 is a perspective view showing the buoyancy unit and the launching/retrieving unit of FIG. 1.

Referring to FIGS. 1 and 6, at least one buoyancy unit 600 is installed on the top end of the body frame 550 of the structure frame 500. The buoyancy unit 600 is equipment for maintaining a suitable ground pressure of the mining robot according to the present invention.

The launching/retrieving unit 700 includes a lifting 710, a thruster control apparatus 720, and an umbilical cable 730.

The lifting 710 protrudes upwardly from a central top end of the body frame 550.

The umbilical cable 730 is connected to the lifting 710.

The thruster control apparatuses 720 are installed to both sides of the body frame 550.

Figure 5:
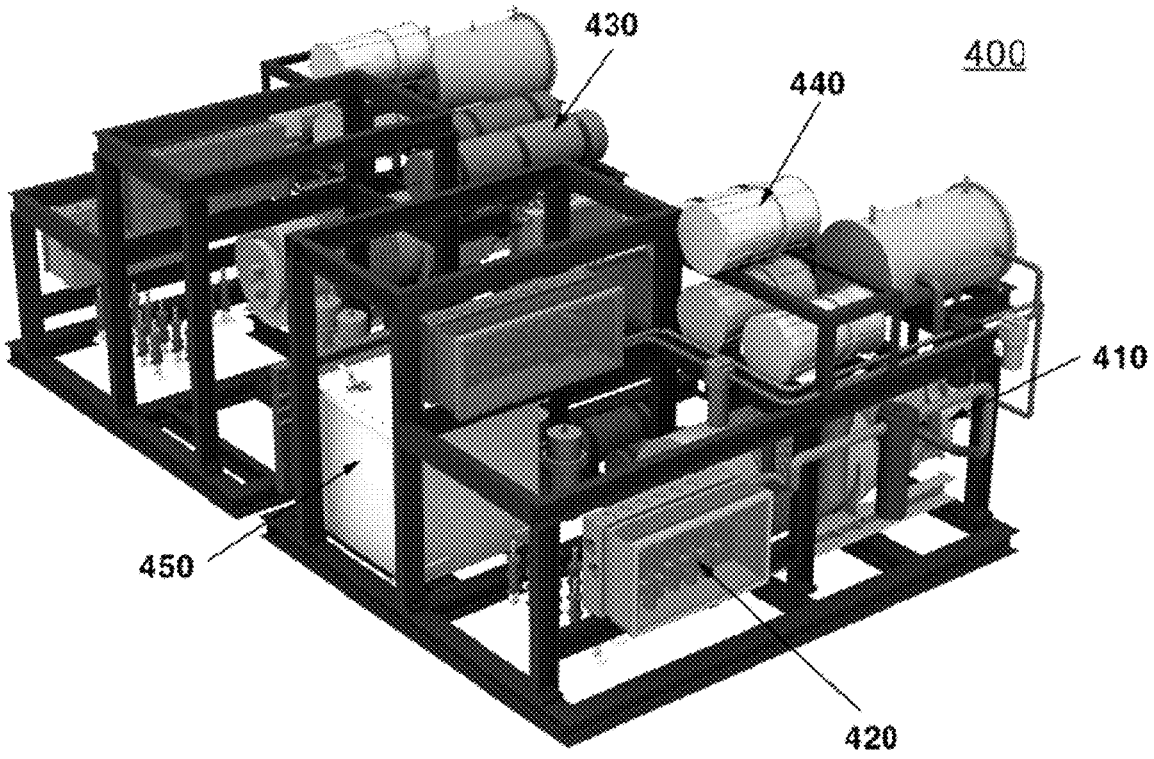
FIG. 5 is a perspective view showing the power control measuring unit of FIG. 1.

In addition, referring to FIG. 5, the power control measuring unit 400 according to the present invention includes a hydraulic power generating apparatus 410, a control valve apparatus 420, a measuring sensor apparatus 430, a pressure compensating apparatus 440 and an electric/electronic apparatus 450. The apparatuses mentioned above are electric/electronic apparatuses to control the power required to drive the moving apparatus 100, the mining apparatus 200 and the transferring apparatus 300.

Hereinafter, an operation of the mining robot described above will be described.

Referring to FIGS. 1 and 2, a robot for mining a manganese nodule on a deep sea floor according to the present invention is transferred to a deep sea floor through a transferring means which is not shown in the drawings.

In this case, an end portion of the transferring pipe 330 is connected to a transferring pipe (not shown) connected to the mother ship. Although no shown in the drawings, a transferring control apparatus and a transferring pump may be provided in the transferring pipe.

The robot for mining a manganese nodule on a deep sea floor according to the present invention is operated after safely arriving at seabed.

In the mining robot, the plurality of moving apparatuses 100, each of which includes the mining apparatus 200 and the transferring apparatus 300, are connected in parallel with each other. The number of connected moving apparatuses 100 may be at least two.

According to the present invention described above, since the moving apparatuses 100 are detachably connected in parallel with each other, the mining apparatus may easily meet a condition of submarine topography and in addition, the ground contact area on the sea floor constituting a weak ground may be easily secured.

The sprockets 121 of the driving apparatus 120 are driven by the power control measuring unit 400.

The sprockets 121 for rotating the endless tracks 110 may be rotated at the same speed or at mutually different speeds.

Thus, the rotation speeds of the endless tracks 110 are variably controlled, respectively, so that the mining apparatus according to the present invention can move straight or circulate on seabed.

In addition, the interval meter measures a distance value from the ground surface of seabed thereto in real time and transmits the measured distance value to the power control measuring unit 400.

The power control measuring unit 400 controls the stretched operation of the shaft 231*a* of the cylinder 231 of the electronic stability control apparatus 230 such that the interval or height value between the apparatus body 211 of the floating apparatus 210 and the ground surface of the seabed is allowed to be equal to the reference interval value.

The bottom end of the apparatus body 211 of the floating apparatus 210 may be placed to be spaced apart from the ground surface of seabed according to the stretching operation of the cylinder 231.

Thus, when the apparatus according to the present invention safely arrives on the ground surface of seabed and moves, the distance spaced between the irregular surface of seabed and the bottom end of the apparatus body 211 of the floating apparatus 210 may be controlled to be maintained at a constant reference interval value.

At the same time, the water jet injection nozzle apparatuses 212 according to the present invention form water jets at the front and rear of both sides of the bottom end of the apparatus body 21 of the floating apparatus 210.

Thus, the manganese nodules existing on the ground surface of seabed may be floated and introduced into the inside of the apparatus body 211 of the floating apparatus 210 by the water jets formed as described above.

At the same time, the floated manganese nodules are conveyed to the crushing apparatus 310 by the carrying apparatus 220.

In this case, since the carrying apparatus 220 includes the plurality of scrapers, the foreign materials formed on the manganese nodules may be dusted while the manganese nodules move.

The dusted manganese nodules are moved along the mining path such that the manganese nodules are placed at an upper portion of the crushing apparatus 310.

The nodules which are moved to the upper portion of the crushing apparatus 310 are transferred to the receiving part.

The crushing apparatus 310 crushes the nodules into a constant size or less.

The crushing apparatus 310 includes the crushing gears engaged with each other to be rotated. The crushing gears are connected to a rotation apparatus (not shown) which receives power from the power control measuring unit 400 to be rotated.

Thus, the manganese nodules pass between the crushing gears engaged with each other to be rotated so that the manganese nodules are crushed in a constant size.

The crushed manganese nodules are transferred into the transferring pipe 330.

The manganese nodules which are crushed in a constant size and transferred into the transferring pipe 330 are carried into the mother ship.

Meanwhile, the robot for mining a manganese nodule on a deep sea floor according to the present invention is operated in the driving scheme described above.

Specifically, the power control measuring unit 400 according to the present invention may independently control the operations of the mining apparatus 200 and the transferring apparatus 300 installed to each moving apparatus 100.

Thus, since the mining apparatuses 200 and the transferring apparatuses 300 according to the present invention can individually mine manganese nodules on a deep sea floor, the amount of mined manganese nodules per a unit time may be increased.

Meanwhile, although not shown in the drawings, the apparatus 200 and the transferring apparatus 300 according to the present invention may further include buffer means (not shown) for buffering an impact caused while the apparatus moves on seabed. The buffer means includes a multi-stage pipe. The multi-stage pipe may be connected to the frame 130 of the moving apparatus 100.

The multi-stage pipe may include elastic springs (not shown) so that the multi-stage pipe may be elastically operable.

Therefore, the frame 130 of the moving apparatus 100 may be elastically moved up and down.

Thus, the buffer means may prevent the mining apparatus 200 and the transferring apparatus 300 from being damaged due to the impact caused while the apparatus moves.

According to the embodiment of the present invention, the moving apparatuses, each of which includes the mining apparatus and the transferring apparatus which are enabled to be individually controlled, are detachably connected in parallel with each other, so that the ground contact area can be increased on a weak sticky ground of a deep sea floor.

Further, according to the embodiment of the present invention, the number of moving apparatuses can be adjusted according to submarine topography of a mining object.

Further, according to the embodiment of the present invention, since the plurality of moving apparatuses can be individually driven, the moving apparatuses can be driven at mutually different rotation speeds, respectively, so that the traversability may be greatly improved at an arbitrary position on submarine topography.

In addition, according to the present invention, each moving apparatus is allowed to have the plurality of mining apparatuses and transferring apparatuses so that the entire mining capacity can be increased.

INDUSTRIAL APPLICABILITY

According to the present invention, the moving apparatuses including a mining apparatus and a transferring apparatus are detachably connected in parallel with each other, so that the number of moving apparatuses is adjustable according to a capacity for mining manganese nodules.

Further, according to the present invention, at least one of the moving apparatuses is changeable.

According to the present invention, the ground contact area can be increased on a weak sticky ground of a deep sea floor.

According to the present invention, the number of moving apparatuses having endless tracks can be adjusted according to submarine topography of a mining object.

According to the present invention, since the plurality of endless tracks may be individually driven, the endless tracks may be driven at mutually different rotation speeds, respectively, so that the traversability may be greatly improved at an arbitrary position on submarine topography.

The invention claimed is:

1. A robot for mining a manganese nodule on a deep sea floor, the apparatus comprising:

a plurality of moving apparatuses detachably disposed in parallel with each other;

a mining apparatus installed to a front end of the moving apparatuses to mine a manganese nodule;

a transferring apparatus installed to an upper portion of the moving apparatuses to crush the manganese nodule in a constant size or less such that the manganese nodule is transferred to an external;

a power control measuring unit installed to an upper portion of the moving apparatuses for providing power to the moving apparatuses and controlling operations of the mining apparatus and the transferring apparatus;

a structure frame for connecting the moving apparatuses to each other and for supporting the mining apparatus, the transferring apparatus and the power control measuring unit; and a buoyancy unit installed to a top end of the structure frame.

2. The apparatus of claim 1, wherein each of the moving apparatuses includes a plurality of endless tracks disposed in parallel with each other in a transverse direction.

3. The apparatus of claim 1, wherein the mining apparatus includes a floating apparatus disposed at a front end of the moving apparatus to inject water jet to seabed such that the manganese nodule placed on the seabed is floated and induced into an inside of the floating apparatus;

a carrying apparatus connected to the floating apparatus to receive power from the power control measuring unit such that the floated manganese nodule is transferred to the transferring apparatus;

an electronic stability control apparatus for receiving power from the power control measuring unit to elevate the floating apparatus and the carrying apparatus such that a preset height is formed between a bottom end of the floating apparatus and the seabed;

a mining apparatus frame for connecting the floating apparatus and the carrying apparatus to each other in a single unit; and a frame to which the electronic stability control apparatus is installed, wherein the frame connects the mining apparatus frame to the structure frame.

4. The apparatus of claim 3, wherein a water jet injection nozzle for injecting the water jet and a flowing guide plate are installed in the floating apparatus.

5. The apparatus of claim 3, wherein the carrying apparatus includes a conveyer belt including a pair of left and right driving chains and a plurality of scrapers for connecting the left and right driving chains to each other;

a plurality of left and right idlers constituting a shape of the conveyer belt; and a pair of left and right sprockets, wherein the carrying apparatus receives power from the power control measuring unit to control the conveyer belt such that the conveyer belt is rotated at a preset rotation speed.

6. The apparatus of claim 3, wherein the electronic stability control apparatus includes an electric control link unit including a pair of left and right parallelogram links and a pair of left and right hydraulic cylinders which receives power from the power control measuring unit to control movements of the left and right parallelogram links, wherein the electronic stability control apparatus receives a value of a distance from a surface of seabed from an interval meter installed to the floating apparatus to control an elevation of the floating apparatus such that the distance value is equal to a preset reference distance value.

7. The apparatus of claim 1, wherein the transferring apparatus includes a crushing apparatus adjacent to the mining apparatus for receiving power from the power control measuring unit to crush the manganese nodule transferred by the carry apparatus at a constant size or less;

a transferring pump connected to the crushing apparatus to receive power from the power control measuring unit such that the crushed manganese nodule is transferred;

a transferring pipe connected to the transferring pump to form a transferring path through which the manganese nodule is transferred to an outside; and a dump valve installed on the transferring pipe to receive power from the power control measuring unit such that the transferring pipe and the transferring pump are prevented from being clogged while the crushed manganese nodule is transferred.

8. The apparatus of claim 1, wherein the structure frame includes a moving apparatus connecting frame for detachably connecting the moving apparatuses to each other;

a mining apparatus connecting frame connected to the moving apparatus connecting frame to support the mining apparatus;

a transferring apparatus connecting frame for supporting the transferring apparatus;

a power control measuring unit connecting frame for supporting the power control measuring unit; and a body frame for connecting the moving apparatus connecting frame, the mining apparatus connecting frame, the transferring apparatus connecting frame and the power control measuring unit connecting frame to each other.

* * * * *